United States Patent [19]

Cox

[11] 4,372,829

[45] Feb. 8, 1983

[54] METHOD AND APPARATUS FOR REMOVING METAL FROM A METAL-LADEN SOLUTION

[76] Inventor: Johnny C. Cox, Rte. 1, Box 227E, Oliver Springs, Tenn.

[21] Appl. No.: 246,330

[22] Filed: Mar. 23, 1981

[51] Int. Cl.[3] ..... C25C 1/22; C25C 7/00

[52] U.S. Cl. ..... 204/109; 204/272; 204/275

[58] Field of Search ..... 204/109, 272, 275

[56] References Cited

U.S. PATENT DOCUMENTS

| | | | |
|---|---|---|---|
| 1,019,969 | 3/1912 | Lacroix | 204/212 |
| 1,159,699 | 11/1915 | Murdock | 204/271 |
| 3,282,823 | 11/1966 | Richards | 204/272 |
| 3,457,152 | 7/1969 | Maloney, Jr. et al. | 204/131 |
| 3,503,856 | 3/1970 | Blackmore | 204/6 |
| 3,583,897 | 6/1971 | Fulweiler | 204/212 |
| 3,694,341 | 9/1972 | Luck, Jr. | 204/273 |
| 3,926,768 | 12/1975 | Burgess | 204/229 |
| 4,026,784 | 5/1977 | Rivers | 204/273 |
| 4,028,212 | 6/1977 | Bowen et al. | 204/272 |
| 4,028,212 | 6/1977 | Bowen et al. | 204/272 |

FOREIGN PATENT DOCUMENTS 835365 2/1970 Canada .

*Primary Examiner*—R. L. Andrews

*Attorney, Agent, or Firm*—Luedeka, Fitch & Neely

[57] ABSTRACT

A method and apparatus for removing metal from a metal containing solution employing an electrolytic cell by introducing a plurality of streams of the metal containing solution into the bottom region of the cell at an acute angle to the radius of a right cylindrical cathode in the cell, and withdrawing solution from the bottom region of the cell approximately at the center of the cathode. The streams of metal containing solution flows in spiral paths along the cylindrical cathode from the bottom region of the cell upwardly toward the top region of the cell to create a vortex effect. The processing by electrolytic removal of the metal on the cathode is improved by the continuous replenishment of solution along the cathode. From the top region of the cell the processed solution moves inwardly and falls toward the bottom region of the cell where it is collected into a central pool and removed from the electrolytic cell.

7 Claims, 4 Drawing Figures

METHOD AND APPARATUS FOR REMOVING METAL FROM A METAL-LADEN SOLUTION

The present invention relates to the removal of metal from a metal containing solution, and more particularly to electrolytic deposition of a metal from an aqueous solution containing ions of that metal.

Electrolytic metal recovery units are well suited for recovering metallic silver from an aqueous solution containing silver ions, such as photographic fixing solutions or "Hypo" solutions used for removing undeveloped silver halides from a film emulsion. Typically, the fixing solution is conveyed from a film processor to a metal recovery unit where the silver is electrolytically deposited on a cathode. As the concentration of silver solution is reduced, the fixing solution may be re-used to develop additional film.

It is desirable to continuously replace the solution located adjacent to the cathode in order to maintain the maximum silver ion concentration at the cathode. The prior art methods and apparatus used to recover silver from an aqueous solution include various concepts for agitating the silver containing solution within an electrolytic cell in an effort to increase the efficiency of silver recovery process by electrolytic deposition. Some of these prior art methods and apparatus employ an agitator located either at the bottom or the top of the electrolytic cell to agitate the solution within the cell. Other prior art methods and apparatus use a hollow centrally disposed anode having nozzles projecting therefrom at various intervals along the anode. The aqueous solution is introduced into the centrally disposed hollow anode and issues therefrom in streams to cause the solution to swirl around the cell.

Typically, however these prior art methods and apparatus cause the solution within the electrolytic cell to move as a mass or body and does not accomplish the desired amount of agitation of the solution to effect rapid replacement of the solution adjacent to the cathode.

It is an object of the present invention to provide an improved method and apparatus for the recovery of metallic metal, particularly silver, from an aqueous solution containing silver ions.

It is a further object of the invention to provide a method and apparatus for removing metal from a metal containing solution which circulates the solution along the cathode of an electrolytic cell in an upwardly moving helical path.

It is yet another object of the present invention to provide a method and apparatus for removing metal from a metal containing solution wherein the processed solution is removed from a location generally centrally disposed within the electrolytic cell at the bottom region of the cell.

These and other objects and advantages of the invention will become apparent from the following specification and claims considered together with the accompanying drawings wherein:

The present invention provides an electrolytic cell 10 particularly adapted for removing metallic silver from an aqueous solution containing silver ions. The electrolytic cell 10 is useful in removing silver from such solutions as the "Hypo" solution used in developing film.

Figure 1:
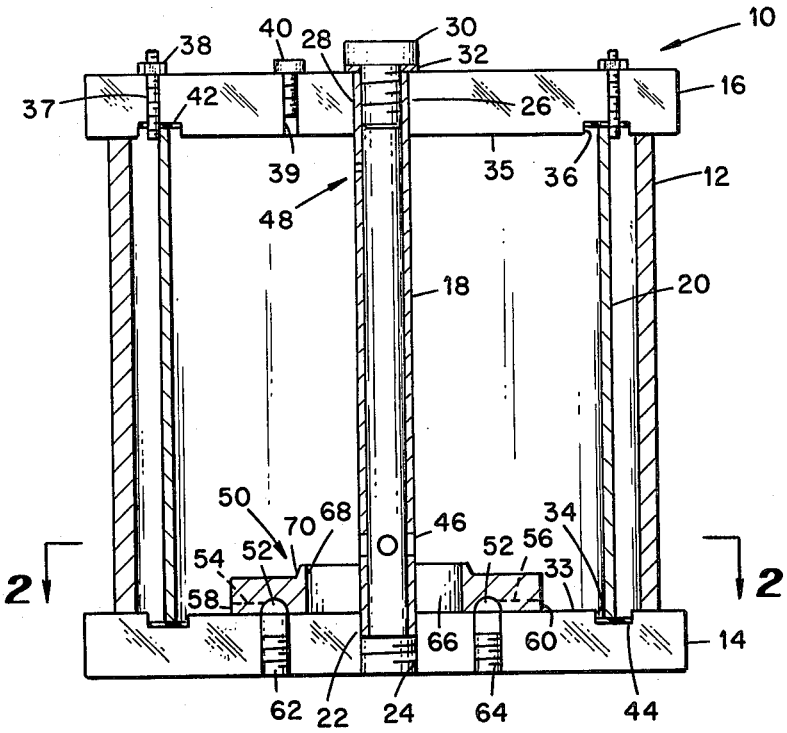
FIG. 1 is a cross-sectional elevational view of an electrolytic cell embodying various features of the present invention.
Figure 2:
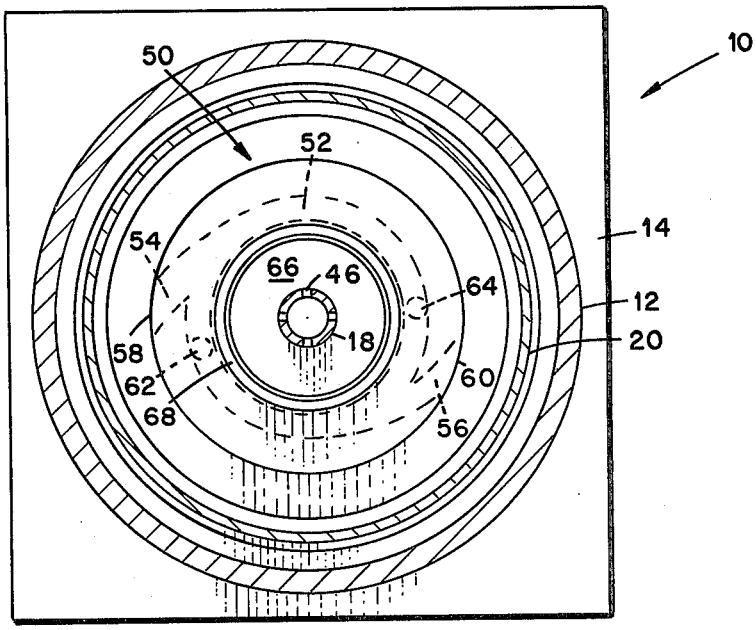
FIG. 2 is a cross-sectional plan view of the electrolytic cell as viewed in the direction of arrows 2—2 in FIG. 1.

Referring to FIGS. 1 and 2, the electrolytic cell 10 embodying various features of the present invention comprises a right cylindrical outer shell 12 closed at the bottom by a generally planar bottom plate 14 and closed at the top by a generally planar top plate 16. A central anode 18 in the form of a hollow cylindrical tube is coaxially disposed within the cylindrical shell 12 and a hollow right cylindrical cathode 20 is disposed within the cylindrical shell 12 concentric with the cylindrical shell 12 and concentrically surrounding the anode 18.

The cylindrical shell 12, bottom plate 14, and top plate 16 are all fabricated of a material which is inert to the aqueous "Hypo" solution. One such suitable material for the fabrication of these components is clear acrylic plastic.

The bottom plate 14 is permanently affixed to the bottom edge of the cylindrical shell 12 by, for example, an appropriate adhesive material and the top plate 16 is removably attached to close the top of the cylindrical shell 12.

The central anode 18 is fabricated of a material which is electrically conductive and which is not corroded by exposure to the "Hypo" solution. One example of such a material is platinum-coated titanium. The illustrated anode 18 comprises a hollow right cylindrical tube which is threaded at its lower end 22 and is threadably received within a threaded aperture 24 passing through the thickness of the bottom plate 14. The upper end 26 of the anode 18 is received through a centrally positioned aperture 28 through the thickness of the top plate 16 when the top plate 16 is in position closing the top of the cylindrical shell 12. The interior wall of the anode 18 at its top end 26 is internally threaded and the top plate 16 is secured in place closing the top end of the cylindrical shell 12 by a bolt 30 which is threadably received in the upper end 26 of the anode 18. A seal 32 is disposed between the top plate 16 and the head of the bolt 30 to create a gas and liquid seal around the central aperture 28 through the top plate 16.

The top surface 33 of the bottom plate 14 is formed with a circular groove 34 and the bottom surface 35 of the top plate 16 is formed with a circular groove 36. These grooves 34 and 36 are nominally the same diameter as the cylindrical cathode 20 and are coaxial with each other and with the cathode. In addition, the top plate 16 is formed with a threaded vent hole 39 selectively closed by, for example, a bolt 40.

The top circular edge of the cylindrical cathode 20 seats in the circular groove 36 of the top plate 16 and is attached to the top plate 16 by means of a plurality of bolts 37 which are attached to the top edge of the cathode 20, as by welding, and are received through appropriate apertures in the top plate 16. Nuts 38 are threaded onto the bolts 37 to secure the cathode 20 to the top plate 16. Therefore, when the top plate 16 is removed, the cathode 20 is simultaneously withdrawn from the electrolytic cell 10. With the top plate 16 in position closing the top of the cylindrical shell 12 the bottom edge of the cathode 20 seats in the circular groove 34 in the top surface 33 of the bottom plate 14. Preferably, a sealing ring 42 is disposed in the circular groove 36 in the bottom surface 35 of the top plate 16 to prevent fluid leakage between the top edge of the cathode and top plate 16. Likewise, a sealing ring 44 is preferably disposed in the circular groove 34 in top surface 33 of the bottom plate 14 to prevent fluid leakage between the bottom edge of the cathode and bottom plate.

As can be best seen in FIGS. 1 and 2, the centrally disposed hollow anode 18 is formed with a plurality of circumferentially spaced apertures 46 through its wall near the lower end 22 of the anode 18 and with a small vent hole 48 near the upper end 26 of the anode 18. The apertures 46 are used to remove processed solution from the electrolytic cell 10 and the vent hole 48 prevents a vacuum from being created in the hollow anode 18 above the apertures 46 which could otherwise interfere with the removal of processed solution through the apertures 46 and into the hollow anode 18.

Figure 3:
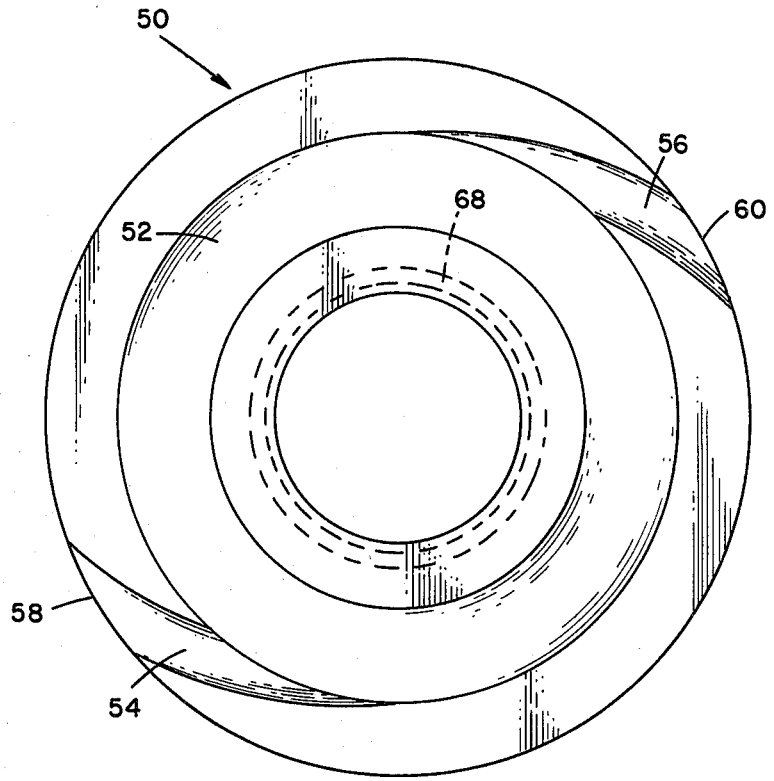
FIG. 3 is an enlarged bottom view of a component of the electrolytic cell of FIG. 1; and, FIG. 4 is a schematic representation of the electrolytic cell of FIG. 1 included in closed loop processing system.

With continued reference to FIGS. 1 and 2, and additional reference to FIG. 3, a solution introducing manifold structure, generally denoted as the numeral 50, is located at the top surface 33 of the bottom plate 14. The manifold 50 comprises a circular inlet passageway 52, concentrically located with the anode 18, and two diametrically opposed outlet branch passageways 54 and 56. The passageways 54 and 56 merge generally tangentially in fluid communication with, and extend arcuately from, the circular inlet passageway 52. The outlet branch passageways 54 and 56 each terminate at an open outlet end 58 and 60, respectively, spaced inwardly from the cylindrical cathode 20. The longitudinal axis of each of the branch passageways 54 and 56 is at an acute angle to the radius of the cathode 20. Thus, streams of solution to be processed flow from the outlet branch passageways 54 and 56 and are directed toward the bottom region of the cathode 20 at an acute angle to the radius of the cylindrical cathode 20. As illustrated, the branch passageways 54 and 56 are oriented to impart a counter-clockwise direction of rotation to the streams of solution, however, it is contemplated that under some situations they would be oriented to impart a clockwise direction of rotation to the streams of solution. Two diametrically opposite solution inlet apertures 62 and 64 are formed through the bottom plate 14 and into the circular passageway 52 for introducing silver containing solution into the circular passageway 52. The inlet apertures 62 and 64 are displaced circumferentially around the circular passageway 52 about 90° clockwise from the branch passageways 54 and 56.

With continued reference to FIGS. 1, 2 and 3, a well 66 is formed by the manifold structure 50 at the bottom plate 14 surrounding the lower end 22 of the anode 18 for collecting processed solution into a pool for removal from the electrolytic cell 10. An upwardly extending weir 68 surrounds the well 66, spaced circumferentially from the anode 18, for separating processed solution which still contains substantial amounts of silver from lighter processed solution containing less silver. The weir 68 diverts the heavier solution back toward the cathode 20, recirculating the higher concentration solution for reprocessing, while the lighter solution is collected into a pool in the well 66. To this end, the outer peripheral surface 70 of the weir 68 slopes downwardly and outwardly at about a 60° angle to the vertical. In the illustrated embodiment of FIG. 1, the apertures 46 in the anode 18 are located above and substantially tangential to the imaginary plane of the top edge of the weir 68.

The manifold structure 50 is illustrated as being fabricated as a unit defining the well 66 with the weir 68 integrally formed with the manifold structure 50. The manifold structure is fabricated of the same material, for example, acrylic plastic, as the bottom plate 14. The manifold structure 50 is affixed to the top surface 33 of the bottom plate 14 by an appropriate adhesive.

In operation, the aqueous solution containing the silver ions is introduced under pressure into the circular passage 52 of the manifold structure 50 through the inlet apertures 62 and 64 in the bottom plate 14. The solution enters the electrolytic cell 10 through the branch passageways 54 and 56 of the manifold structure 50 in streams directed in a counter-clockwise direction toward the cylindrical cathode 20 at an acute angle to the radius of the cylindrical cathode 20. The force and direction of the incoming streams create a vortex effect within the cell 10. The streams of aqueous solution move in a counter-clockwise helical path upwardly along the cylindrical cathode 20 from the bottom region of the cell 10 near the bottom plate 14 toward the upper region of the cell 10 near the top plate 16. As the solution moves generally helically along the cathode 20, silver ions are electrolytically separated out of the solution and are deposited on the cathode. As the solution reaches the upper region of the cell 10 near the top plate 16, it falls inwardly from the top region of the cell 10 downwardly toward the bottom region of the cell 10 near the bottom plate 14 generally around the exterior of the anode 18. The heavier processed solution, containing higher concentrations of silver ions falls closer to the cathode 20 and is separated from the lighter processed solution by the weir 68. The heavier solution is diverted by the weir 68 back toward the cathode 20 where it is merged with the streams of solution coming out of the branch passageways 54 and 56 and is carried upwardly in a helical path along the cathode 20 for reprocessing while the lighter solution is collected into a pool in the well 66. A suction is applied to the interior of the anode 18 through its open bottom end 22 which causes the pool of solution in the well 66 to be drawn through the apertures 46 and into the anode 18. This removal of solution through the bottom center of the cell enhances the counter-clockwise vortex effect created by the incoming streams of solution. As previously mentioned, the small vent hole 48 near the top of the anode 18 prevents a vacuum from being formed in the anode 18 above the apertures 46 which would otherwise interfere with the drawing of the solution through the apertures 46. The vent hole 39 also serves to maintain atmospheric pressure within the cell 10.

To remove separated silver deposited on the cathode from the electrolytic cell 10, the top plate 16 is simply removed by removing the bolt 30. When the top plate 16 is removed, the cathode 20 is simultaneously removed from the cell 10 because they are attached.

Figure 4:
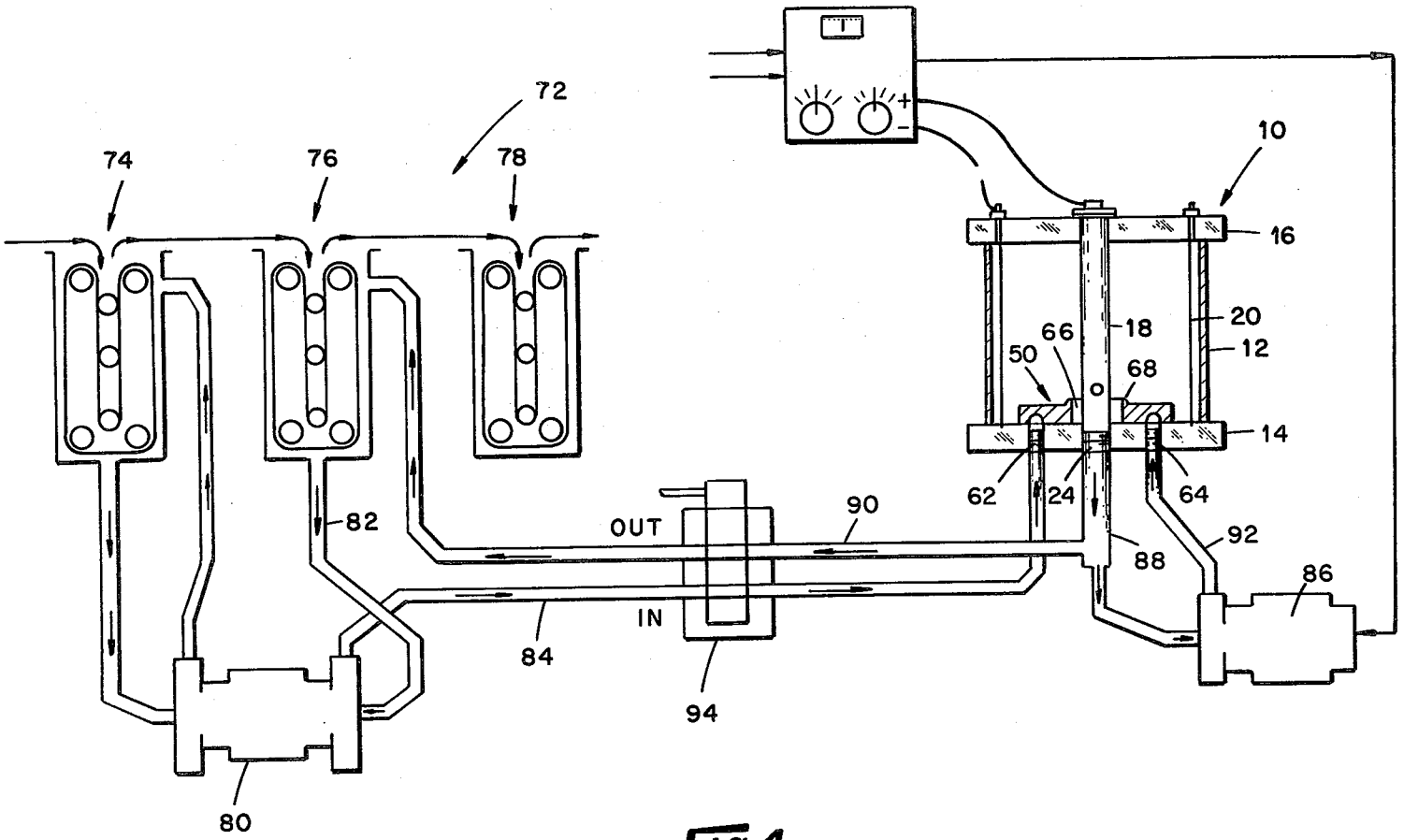

FIG. 4 illustrates a typical system 72 incorporating the electrolytic cell 10. In this illustrated system 72 a photographic film to be developed is sequentially passed through a developer tank 74, a fixer tank 76 and a washer tank 78. The fixer tank 76 is in fluid communication with a recirculation pump 80 through a conduit 82. The recirculation pump 80 is also in fluid communication with one of the inlet apertures 62 into the circular inlet passageway 52 of the manifold structure 50 in the electrolytic cell 10 by means of a conduit 84. Another recirculation pump 86 has its suction side in fluid communication with the interior of the anode 18 through a conduit 88 interconnecting the aperture 24 in the bottom plate 14 with the suction side of the pump 86. The fixer tank 76 is also in fluid communication with the conduit 88, which interconnects the anode 18 with the recirculation pump 86, through another conduit 90. The pressure side of the recirculation pump 86 is in fluid communication with the other one of the inlet apertures 64 into the circular inlet passageway 52 of the manifold structure 50 in the electrolytic cell 10 through a conduit 92. A bypass valve 94 is located in the conduits 84 and 90 so that fixing solution or "Hypo" coming from the fixer tank 76 can be routed to bypass the electrolytic cell 10 and flow directly back into the fixer tank 76.

With reference to the flow arrows in the diagram of FIG. 4, the fixing solution from the fixer tank 76 is pumped out of the bottom of the fixer tank 76 into the conduit 82 by the recirculation pump 80 and moves from the recirculation pump 80 through the conduit 84 and into the manifold structure 50 inside the electrolytic cell 10 where it issues from the branch passageways 54 and 56 in streams for processing by removal of the silver. Concurrently, the solution in the tank which has been processed and is at least partially depleted of silver is removed from the well 66 in the electrolytic cell 10 through the apertures 64 in the anode 18 through the conduit 88 by the pump 86. A portion of this processed solution passes through the conduit 88 to the recirculation pump 86, and from the recirculation pump 86 through the conduit 92 to the inlet aperture 64 of the manifold structure 50 inside the electrolytic cell 10 where it issues from branch passageway 64 in a stream for reprocessing and removal of any residual silver. A portion of the solution from the anode 18 passes through the conduit 88 and is diverted from the recirculation pump 86 through the conduit 90 and back to the fixing tank 76 for reuse.

Virtually any conventional or otherwise convenient electrical control system can be used to energize the anode and cathode of the electrolytic cell 10.

Employing the present invention, improved removal of silver from solution is achieved. It is believed that the improvement results from the more rapid replenishment of silver-laden solution in contact with the cathode which apparently arises from the vortex effect achieved within the cell along the cathode surface.

The foregoing detailed description is given primarily for clearness of understanding, and no unnecessary limitations should be understood therefrom for modifications will become obvious to one skilled in the art upon reading this disclosure and may be made without departing from the spirit of the invention nor the scope of the appended claims.

What is claimed is:

1. A method for recovery of metallic silver from a solution containing silver ions employing an electrolytic cell that includes a hollow anode disposed concentrically within a hollow cylindrical cathode comprising the steps of:

applying an electrolysis current to said anode and cathode, directing streams of said solution from outlets of a manifold located in the bottom region of said electrolytic cell, said outlets being radially spaced outwardly from said anode, toward said cylindrical cathode and at an acute angle to the radius of said cylindrical cathode to develop a vortex carrying solution helically upwardly along said cathode for processing contact with said cathode; and withdrawing a portion of said processed solution from the bottom region of said electrolytic cell through apertures located radially inwardly from said manifold outlets.

2. The method of claim 1, wherein said streams of solution entering said electrolytic cell follow an arcuate path generally toward said cylindrical cathode.

3. In an electrolytic cell for removing metallic silver from a solution containing silver ions of the type including a source of solution, a hollow anode disposed concentrically within a hollow right cylindrical cathode, the improvement comprising:

manifold means connected to said source and disposed near the bottom region of said electrolytic cell for directing a plurality of streams of said solution from manifold outlets, said outlets being radially spaced outwardly from said anode, toward the said cylindrical cathode at an acute angle to the radius of said cylindrical cathode; and, means for removing a portion of said processed solution from said electrolytic cell near the bottom region of said electrolytic cell radially inwardly from said manifold outlets whereby a continuously replenished vortex of solution contacts the said cathode.

4. The electrolytic cell of claim 3, wherein said manifold means for directing streams of solution into said electrolytic cell comprises means defining a plurality of solution conveying passageways located at the bottom region of said electrolytic cell, each passageway having its longitudinal axis oriented generally at an acute angle to the radius of said cylindrical cathode.

5. The electrolytic cell of claim 3, wherein said means for removing said solution from said cathode comprises a plurality of apertures formed through said anode near the bottom region of said electrolytic cell.

6. The electrolytic cell of claim 3 wherein said manifold means includes weir means circumferentially spaced outwardly from said anode and inwardly from said outlets, whereby solution carrying low concentration of silver ions is separated for withdrawal and solution carrying high concentrations of silver ions is diverted toward said cathode for recirculation within said cell.

7. The electrolytic cell of claim 3 wherein vent means are provided in the upper portion of said hollow anode to prevent the development of a vacuum within said anode.

* * * * *